US006361417B2

(12) United States Patent
Walker et al.

(10) Patent No.: US 6,361,417 B2
(45) Date of Patent: Mar. 26, 2002

(54) METHOD AND APPARATUS FOR SUPPORTING A POLISHING PAD DURING CHEMICAL-MECHANICAL PLANARIZATION OF MICROELECTRONIC SUBSTRATES

(75) Inventors: Michael A. Walker, Kuna; Karl M. Robinson, Boise, both of ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/795,248

(22) Filed: Feb. 27, 2001

Related U.S. Application Data

(63) Continuation of application No. 09/387,065, filed on Aug. 31, 1999.

(51) Int. Cl.[7] ..... B24B 1/00

(52) U.S. Cl. ..... 451/168; 451/41; 451/59; 451/60; 451/287; 451/296; 451/303

(58) Field of Search ..... 451/41, 59, 60, 451/287, 288, 296, 299, 303, 307

(56) References Cited

U.S. PATENT DOCUMENTS 5,722,877 A * 3/1998 Meyer et al. ..... 451/41
5,961,372 A * 10/1999 Shendon ..... 451/41
6,068,542 A * 5/2000 Hosokai ..... 451/37
6,135,859 A * 10/2000 Tietz ..... 451/41

* cited by examiner

*Primary Examiner*—Joseph J. Hail, III
*Assistant Examiner*—Shantese McDonald
(74) *Attorney, Agent, or Firm*—Dorsey & Whitney LLP

(57) ABSTRACT

A method and apparatus for planarizing a microelectronic substrate. In one embodiment, the apparatus can include an elongated polishing pad that is moved over a platen either between or during the planarization cycles, and a support pad that is moved along with the polishing pad. The support pad can be an elongated member that extends between a supply roller and a take-up roller, or can include a continuous member that extends around the spaced apart rollers. The platen can also be movable along with the support pad and can be supported by fluid jets, rollers, or a rotating bladder. Cleaning devices and/or milling devices can treat the surfaces of the polishing pad, the support pad and/or the platen to reduce the likelihood for contaminants to become caught between these components as they engage with each other.

86 Claims, 8 Drawing Sheets

METHOD AND APPARATUS FOR SUPPORTING A POLISHING PAD DURING CHEMICAL-MECHANICAL PLANARIZATION OF MICROELECTRONIC SUBSTRATES

CROSS-REFERENCE TO RELATED APPLICATION

This application is a continuation of pending U.S. patent application No. 09/387,065, filed Aug. 31, 1999.

TECHNICAL FIELD

The present invention is directed toward methods and apparatuses for supporting a polishing pad relative to a microelectronic substrate during mechanical and/or chemical-mechanical planarization.

BACKGROUND OF THE INVENTION

Mechanical and chemical-mechanical planarizing processes (collectively "CMP") are used in the manufacturing of microelectronic devices for forming a flat surface on semiconductor wafers, field emission displays, and many other microelectronic-device substrates and substrate assemblies. FIG. 1 is a partially schematic isometric view of a conventional web-format planarizing machine 10 that has a platen 20. A sub-pad 50 is attached to the platen 20 to provide a flat, solid workstation for supporting a portion of a web-format planarizing pad 40 in a planarizing zone "A" during planarization. The planarizing machine 10 also has a pad-advancing mechanism, including a plurality of rollers, to guide, position, and hold the web-format pad 40 over the sub-pad 50. The pad-advancing mechanism generally includes a supply roller 24, first and second idler rollers 21*a* and 21*b*, first and second guide rollers 22*a* and 22*b*, and a take-up roller 23. As explained below, a motor (not shown) drives the take-up roller 23 to advance the pad 40 across the sub-pad 50 along a travel path T—T. The motor can also drive the supply roller 24. The first idler roller 21*a* and the first guide roller 22*a* press an operative portion of the pad 40 against the sub-pad 50 to hold the pad 40 stationary during operation.

The planarizing machine 10 also has a carrier assembly 30 to translate a substrate 12 over the polishing pad 40. In one embodiment, the carrier assembly 30 has a head 31 to pick up, hold and release the substrate 12 at appropriate stages of the planarizing process. The carrier assembly 30 also has a support gantry 34 and a drive assembly 35 that can move along the gantry 34. The drive assembly 35 has an actuator 36, a driveshaft 37 coupled to the actuator 36, and an arm 38 projecting from the driveshaft 37. The arm 38 carries the head 31 via a terminal shaft 39. The actuator 36 orbits the head 31 about an axis B—B (as indicated by arrow $R_1$) and can rotate the head 31 (as indicated by arrow $R_2$) to move the substrate 12 over the polishing pad 40 while a planarizing fluid 43 flows from a plurality of nozzles 45 in the head 31. The planarizing fluid 43 may be a conventional CMP slurry with abrasive particles and chemicals that etch and/or oxidize the substrate 12, or the planarizing fluid 43 may be a non-abrasive planarizing solution without abrasive particles. In most CMP applications, conventional CMP slurries are used on conventional polishing pads, and planarizing solutions without abrasive particles are used on fixed-abrasive polishing pads.

In the operation of the planarizing machine 10, the polishing pad 40 moves across the sub-pad 50 along the travel path T—T either during or between planarizing cycles to change the particular portion of the polishing pad 40 in the planarizing zone A. For example, the supply and take-up rollers 24, 23 can drive the polishing pad 40 between planarizing cycles such that a point P moves incrementally across the sub-pad 50 to a number of intermediate locations $I_1$, $I_2$, etc. Alternatively, the rollers 24, 23 may drive the polishing pad 40 between planarizing cycles such that the point P moves all the way across the sub-pad 50 to completely remove a used portion of the polishing pad 40 from the planarizing zone A. The rollers 24, 23 may also continuously drive the polishing pad 40 at a slow rate during a planarizing cycle such that the point P moves continuously cross the sub-pad 50 during planarization. In any case, the motion of the polishing pad 40 is generally relatively slow when the substrate 12 engages the polishing pad 40 and the relative motion between the substrate 12 and the polishing pad 40 is primarily due to the motion of the head 31.

One drawback with the apparatus shown in FIG. 1 is that debris can become caught between the polishing pad 40 and the sub-pad 50. The debris can cause a local bump or other non-uniformity in the polishing pad 40 which can create a corresponding non-uniformity in the substrate 12 and/or can cause the polishing pad 40 to wear in a non-uniform manner.

A further drawback is that the polishing pad 40 can adhere to the sub-pad 50 during planarization. This adhesive bond must be broken in order to advance the polishing pad 40. In one conventional method, the idler rollers 21*a*, 21*b* and/or the guide roller 22*a* are actuated to move the polishing pad 40 normal to the upper surface of the sub-pad 50 and break the adhesive bond. However, moving the polishing pad 40 normal to the sub-pad 50 can flex the polishing pad 40 and cause cracks, pits, and other defects to form in the polishing pad 40, which can in turn create non-uniformities in the planarized surface of the substrate 12.

Another drawback is that the polishing pad 40 and the sub-pad 50 can wear or abrade as they rub against each other. Accordingly, the polishing pad 40 and the sub-pad 50 may need to be replaced on a frequent basis and/or the polishing pad 40 may develop non-uniformities.

One conventional CMP apparatus which may address some of the foregoing drawbacks includes a polishing pad that forms a continuous loop and that moves a high speed relative to the substrate, in the manner of a belt sander. FIG. 2 is a partially schematic side elevation view of one such conventional CMP apparatus 10*a* having a continuous polishing pad 40*a* extending around two rollers 25. The polishing pad 40*a* can be supported by a continuous support band 41, formed from a flexible material, such as a thin sheet of stainless steel. A pair of platens 20*a* provide additional support for the polishing pad 40*a* at two opposing planarizing stations. Two carriers 30*a*, each aligned with one of the platens 20*a* can each bias a substrate 12 against opposing outwardly-facing portions of a planarizing surface 42*a* of the polishing pad 40*a*. Devices such as the apparatus 10*a* shown in FIG. 2 and having vertically oriented planarizing stations are available from Aplex, Inc. of Sunnyvale, Calif. under the name AVERA™. Generally similar devices having a horizontally-oriented polishing pad 40*a* and a single carrier 30*a* are available from Lam Research Corporation of Fremont, Calif.

During operation, the continuous polishing pad 40*a* moves at a relatively high speed around the rollers 25 while the carriers 30*a* press the substrates 12 against the polishing pad 40*a*. An abrasive slurry is introduced to the planarizing surface 42*a* of the polishing pad 40*a* so that the slurry, in combination with the motion of the polishing pad 40*a* relative to the substrates 12, mechanically removes material from the substrates 12.

One drawback with the apparatus 10*a* shown in FIG. 2 is that the polishing pad 40*a* must move at a high speed to effectively planarize the substrates 12. The high-speed polishing pad 40*a* can present a safety hazard to personnel positioned nearby, for example, if the polishing pad 40*a* should break, loosen, or otherwise malfunction during operation.

Another drawback is that the combination of the polishing pad 40*a* and the support band 41 may also wear more quickly than other polishing pads because both the planarizing surface 42*a* of the polishing pad 40*a* and a rear surface 44 of the support band 41 rub against relatively hard surfaces (i.e., the polishing pad 40*a* rubs against the substrate 12 and the support band 41 rubs against the platen 20*a*). This drawback can be serious because, once a defect forms in the polishing pad 40*a*, it can affect each subsequent substrate 12.

Still another drawback is that the interface between the support band 41 and the platens 20*a* can be difficult to seal, due to the high speed of the support band 41. Accordingly, the abrasive slurry can seep between and abrade the support band 41 and the platens 20*a*.

SUMMARY OF THE INVENTION

The present invention is directed to methods and apparatuses for planarizing microelectronic substrates. In one aspect of the invention, the apparatus can include a platen that supports a movable support pad which in turn supports a polishing pad against which the substrate is pressed to remove material from the substrate. The polishing pad can be an elongated web-format type pad that moves across the platen between or during planarizing cycles. The support pad can move at approximately the same rate as the polishing pad, reducing or eliminating relative motion between the two when they are in contact with each other and aligned with the platen.

In one aspect of the invention, the apparatus can include cleaning and/or milling devices to treat the surfaces of the polishing pad and/or the support pad before they engage each other. The support pad can be a continuous loop or can extend from a supply roller to a take-up roller. The platen can also be in the form of a continuous loop or an elongated member that extends from a supply roller to a take-up roller and can be integrated with the support pad in a further aspect of the invention. The platen can be supported by rollers, fluid jets, or a pressurized bladder, and in yet a further aspect of the invention, can include orifices for directing fluid against the support pad to further reduce the likelihood for abrasive contact between the support pad and the platen.

In a method in accordance with an aspect of the invention, at least part of the support pad can be positioned between the platen and the polishing pad of a planarizing machine. The polishing pad can be moved at a first rate to move a first portion of the polishing pad into alignment with the platen while moving a second portion of the polishing pad out of alignment with the platen. The support pad can be moved at a second rate approximately the same as the first rate to engage a first portion of the support pad with the first portion of the polishing pad and disengage a second portion of the support pad from the second portion of the polishing pad. In one aspect of the invention, the platen can be movable along with the support pad and can be tensioned by directing a flow of fluid toward the platen, biasing a roller against the platen or pressing a bladder against the platen.

DETAILED DESCRIPTION OF THE INVENTION

The present invention is directed towards methods and apparatuses for planarizing microelectronic substrates and/or substrate assemblies. Many specific details of certain embodiments of the invention are set forth in the following description and in FIGS. 3–8 to provide a thorough understanding of such embodiments. One skilled in the art, however, will understand that the present invention may have additional embodiments, or that the invention may be practiced without several of the details described in the following description.

Figure 3:
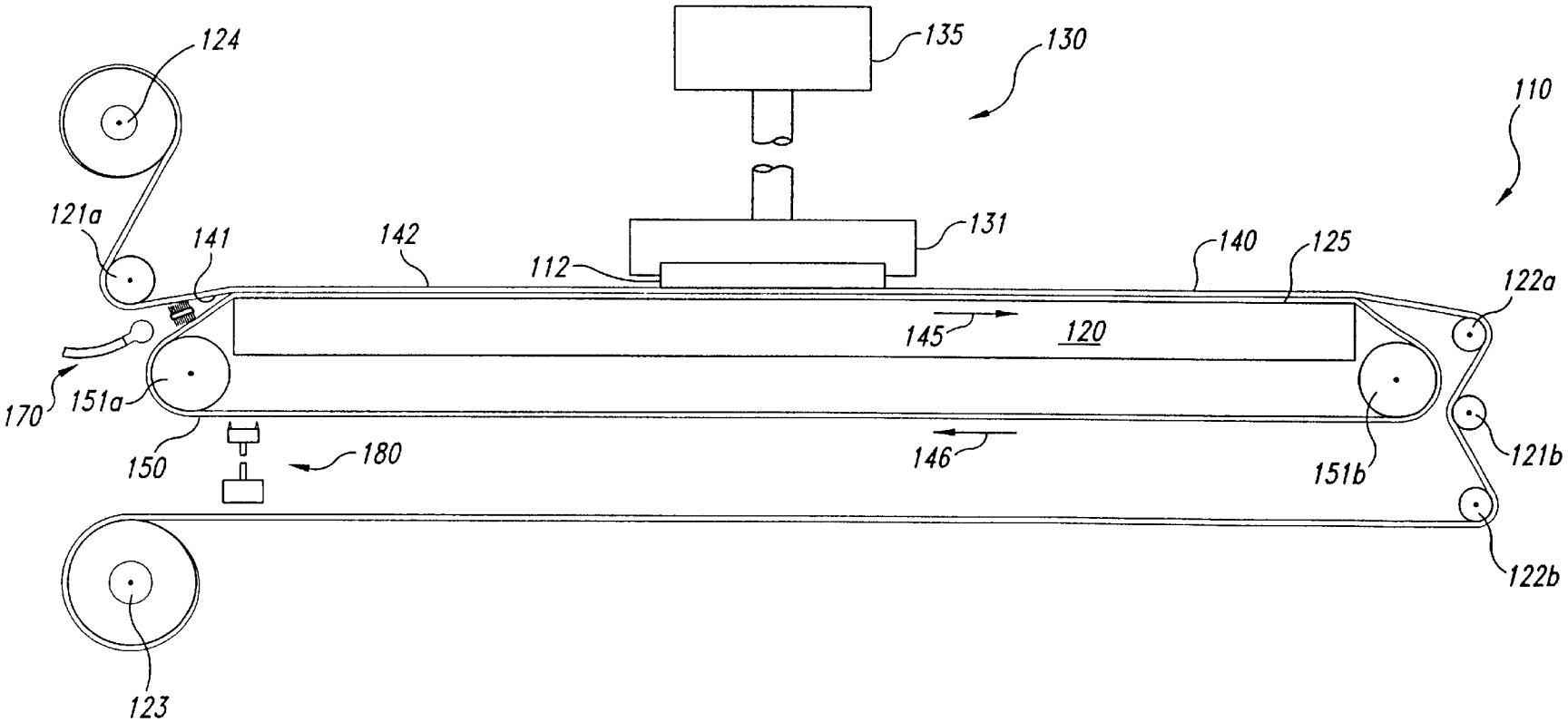
FIG. 3 is a partially schematic, side elevation view of a planarizing machine having a movable support pad in accordance with an embodiment of the invention.

FIG. 3 is a partially schematic, side elevation view of a planarizing machine 110 having a polishing pad 140 supported on a moving support pad 150. The polishing pad 140 can extend from a supply roller 124 across a platen 120 to a take-up roller 123, while being controlled and guided by two idler rollers 121*a*, 121*b* and two guide rollers 122*a*, 122*b*, generally as was discussed above. The polishing pad 140 can have a planarizing surface 142 facing toward a substrate or substrate assembly 112 and a back surface 141 facing opposite the planarizing surface 142. A carrier assembly 130 positioned adjacent the polishing pad 140 can include a head 131 that biases the substrate 112 against the polishing pad 140 during operation. An actuator 135 can move the head 131 relative to the polishing pad 140 to remove material from the substrate 112. The polishing pad 140 can advance from the supply roller 124 to the take-up roller 123 either between or during planarization cycles, in a manner generally similar to that discussed above.

The support pad 150 fits between the back surface 141 of the polishing pad 140 and a support surface 125 of the platen 120, and can move with the polishing pad 140 across the platen 120. For example, in one embodiment, the support pad 150 forms a continuous loop that extends around two support pad rollers 151 (shown as a left roller 151*a* and a right roller 151*b*) positioned on opposite sides of the platen 120. An upper leg of the loop moves from left to right along with the polishing pad 140 (as indicated by arrow 145) and a lower leg of the loop moves from right to left (as indicated by arrow 146). In one aspect of this embodiment, the support pad rollers 151 are rotatable but unpowered, and the frictional force between the polishing pad 140 and the support pad 150 is sufficient to slide the support pad 140 over the platen 120 as the polishing pad 140 advances from the supply roller 124 to the take-up roller 123. Alternatively, either or both of the support pad rollers 151 can be powered. In any case, the support pad 150 can move relative to the platen 120 at approximately the same rate as does the polishing pad 140 so that the portion of the support pad 150 between the polishing pad 140 and the platen 120 is generally fixed relative to the polishing pad 140.

The apparatus 110 can include cleaning devices 170 and a milling device 180 that treat the polishing pad 140 and the support pad 150 before they come together on the platen 120. Further details of the structure and operation of the cleaning devices 170, the milling device 180 and the support pad 150 will be discussed below with reference to FIG. 4.

Figure 4:
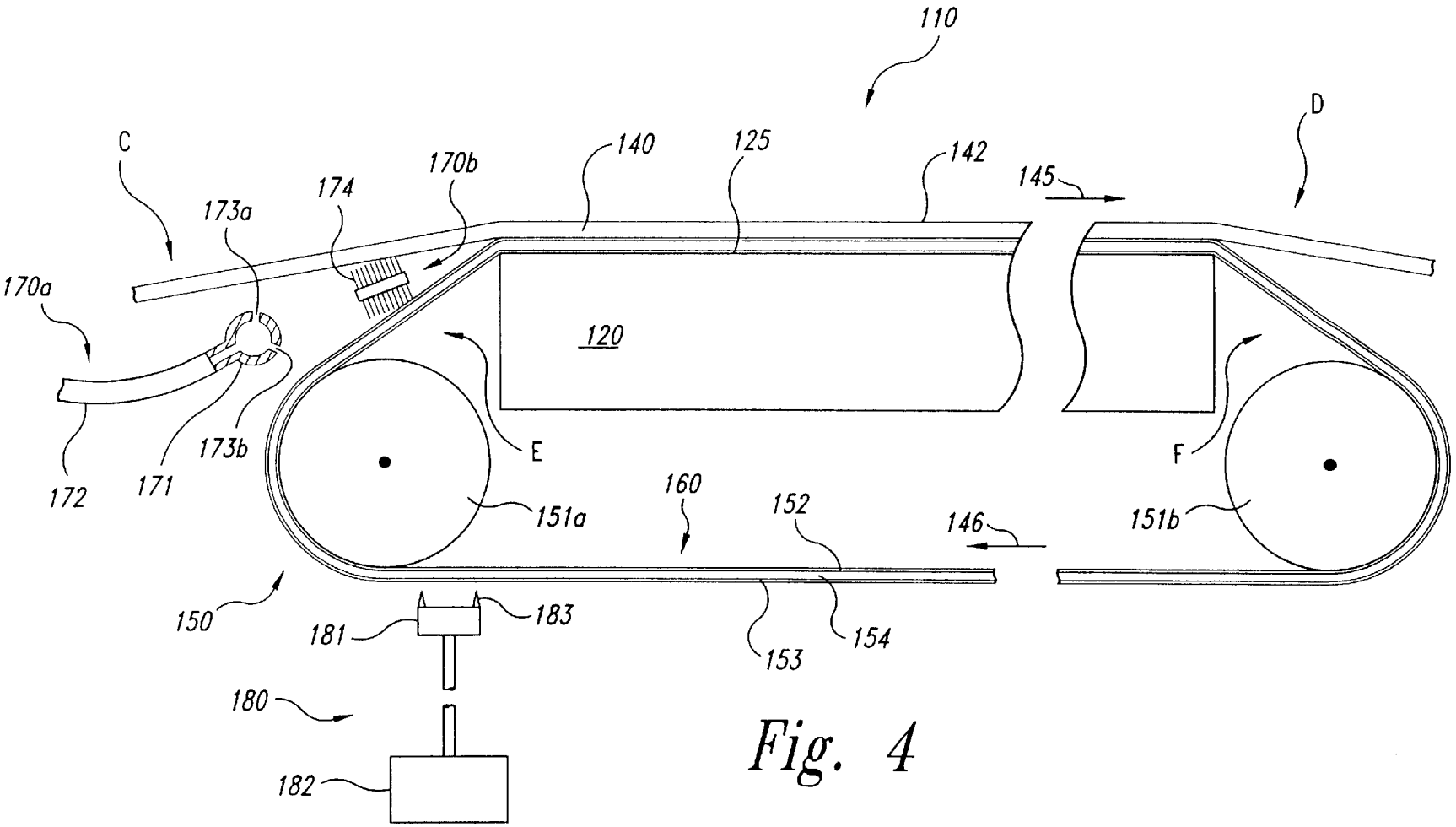
FIG. 4 is a partially schematic, side elevation view of a portion of the apparatus shown in FIG. 3.

FIG. 4 is a detailed side elevation view of a portion of the apparatus 110 shown in FIG. 3. As shown in FIG. 4, the support pad 150 can include a pad body 160 having a composite structure with an inner layer 152 facing toward the platen 120, an outer layer 153 facing opposite the inner layer 152, and a core 154 between the inner and outer layers 152, 153. In one embodiment, the inner and outer layers 152, 153 can include a relatively rigid, incompressible material, such as fiberglass or Mylar®, and the core 154 can include a relatively flexible or compressible material, such as a gel or a foam, including, for example, a urethane foam. Alternatively, the pad body 160 can have a uniform composition that can include either a relatively compressible material or a relatively incompressible material. In any case, the support pad 150 can reduce the effect of contaminants on the uniformity of the planarizing surface 142. For example, when the support pad 150 is at least partially compressible, it can flex to reduce the effect on the planarizing surface 142 of a contaminant trapped between the support pad 150 and the platen 120. When the support pad 150 is more rigid, it can distribute the effect of the contaminant over a large area, which can also reduce the effect of the contaminant on the uniformity of the planarizing surface 142.

The support pad 150 can reduce the effect of contaminants that might be positioned between the support pad 150 and the platen 120, as discussed above. The cleaning devices 170 (shown as a fluid system 170*a* and a brush 170*b*) and the milling device 180 can reduce the likelihood for contaminants to become trapped between the support pad 150 and the polishing pad 140 by treating the surfaces of the polishing pad 140 and/or the support pad 150 before the two engage each other and pass over the platen 120. For example, the fluid system 170*a* can include a manifold 171 having a plurality of apertures 173 (shown as an upward-facing aperture 173*a* facing toward the polishing pad 140 and a downward-facing aperture 173*b* facing toward the support pad 150). The manifold 171 can be coupled with a conduit 172 to a fluid source (not shown), such as a source of liquid or gas. The fluid can be pumped through the manifold 171 and the orifices 173 to impinge on and wash contaminants from the polishing pad 140 and the support pad 150. For example, the manifold 171 can be coupled to both a liquid source and a gas source to clean the polishing pad 140 and the support pad 150 with liquid and then dry the polishing pad 140 and the support pad 150 with the gas. Alternatively, the conduit 172 can be coupled to a vacuum source (not shown) for removing the contaminants under the force of a vacuum.

The brush 170*b* can include bristles 174 facing toward the polishing pad 140 and/or the support pad 150 to scrub contaminants therefrom. In one aspect of this embodiment, the brush 170*b* can be coupled to an actuator (not shown) to move the brush 170*b* into engagement with the polishing pad 140 and/or the support pad 150 during a cleaning cycle and out of engagement after the cleaning cycle is complete. In one embodiment, both the brush 170*b* and the fluid system 170*a* can be positioned adjacent the outer layer 153. Alternatively, the brush 170*b* can include bristles 174 adjacent the inner layer 152 and the fluid system 170*a* can include orifices 173 directed toward the inner layer 152 for removing contaminants from the inner layer 152.

The milling device 180 can include a head 181 having sharpened surfaces 183 for removing a layer of material from the support pad 150. The head 181 can be coupled to an actuator 182 that moves the head 181 into and out of engagement with the support pad 150 and that rotates or otherwise moves the head 181 in the plane of the support pad 150 for removing material from the support pad 150. In one aspect of this embodiment, the head 181 can be positioned adjacent to the outer layer 153 of the support pad 150 to form a smooth surface at the outer layer (for example, if the outer layer 153 becomes abraded during use). Alternatively, the head 181 can be positioned proximate to the inner layer 152 of the support pad 150 which may become abraded as a result of contact with the platen 120. In another embodiment, one head 181 can be positioned adjacent the inner layer 152 and a second head 181 can be positioned adjacent the outer layer 153 to smooth both opposite facing surfaces of the support pad 150.

In operation, the polishing pad 140 moves over the platen 120 from the supply roller 124 (FIG. 3) to the take-up roller 123 (FIG. 3), either between or during planarizing cycles. As the polishing pad 140 advances over the platen 120, an incoming portion C of the polishing pad 140 moves into alignment with the platen 120 so that it is positioned directly opposite the support surface 125 of the platen 120. At the same time, an outgoing portion D of the polishing pad 140 moves out of alignment with the platen 120. As the polishing pad 140 moves relative to the platen 120, the support pad 150 moves at approximately the same rate so that an incoming portion E of the support pad 150 moves into alignment with the platen 120 between the platen 120 and the polishing pad 140, and an outgoing portion F of the support pad 150 moves out of alignment with the platen 120. The incoming portion E of the support pad 150 supports the incoming portion C of the polishing pad 140 relative to the platen 120 while the carrier assembly 130 (FIG. 3) presses the substrate 112 (FIG. 3) against the polishing pad 140.

One feature of the apparatus 110 shown in FIGS. 3 and 4 is that the support pad 150 moves together with the polishing pad 140 relative to the platen 120. One advantage of this feature is that the polishing pad 140 will not wear as a result of relative motion with the support pad 150 because the two move together at approximately the same rate when they are in contact with each other. Any wear due to relative motion with the platen 120 is instead borne by the support pad 150, which bears against the fixed platen 120. Accordingly, the support pad 150 can include materials selected for abrasion resistance, or alternatively, the support pad 150 can include relatively inexpensive materials that may not be particularly wear-resistant, but are economical to replace.

Another advantage is that it is not necessary to move the guide rollers 122 (FIG. 3) and/or the idler rollers 121 (FIG.

3) normal to the polishing pad 140 to force the polishing pad 140 out of engagement with the support pad 150. Instead, the polishing pad 140 and the support pad 150 separate from each other as the polishing pad 140 passes over the first guide roller 122a and the support pad 150 diverges and passes over the right roller 151*b*. The interfacing surfaces of the polishing pad 140 and the support pad 150 can diverge even if the interfacing surfaces are wet, so that the interfacing surfaces can be cleansed with a liquid without substantially affecting the manner in which the support pad 150 separates from the polishing pad 140.

Figure 1:
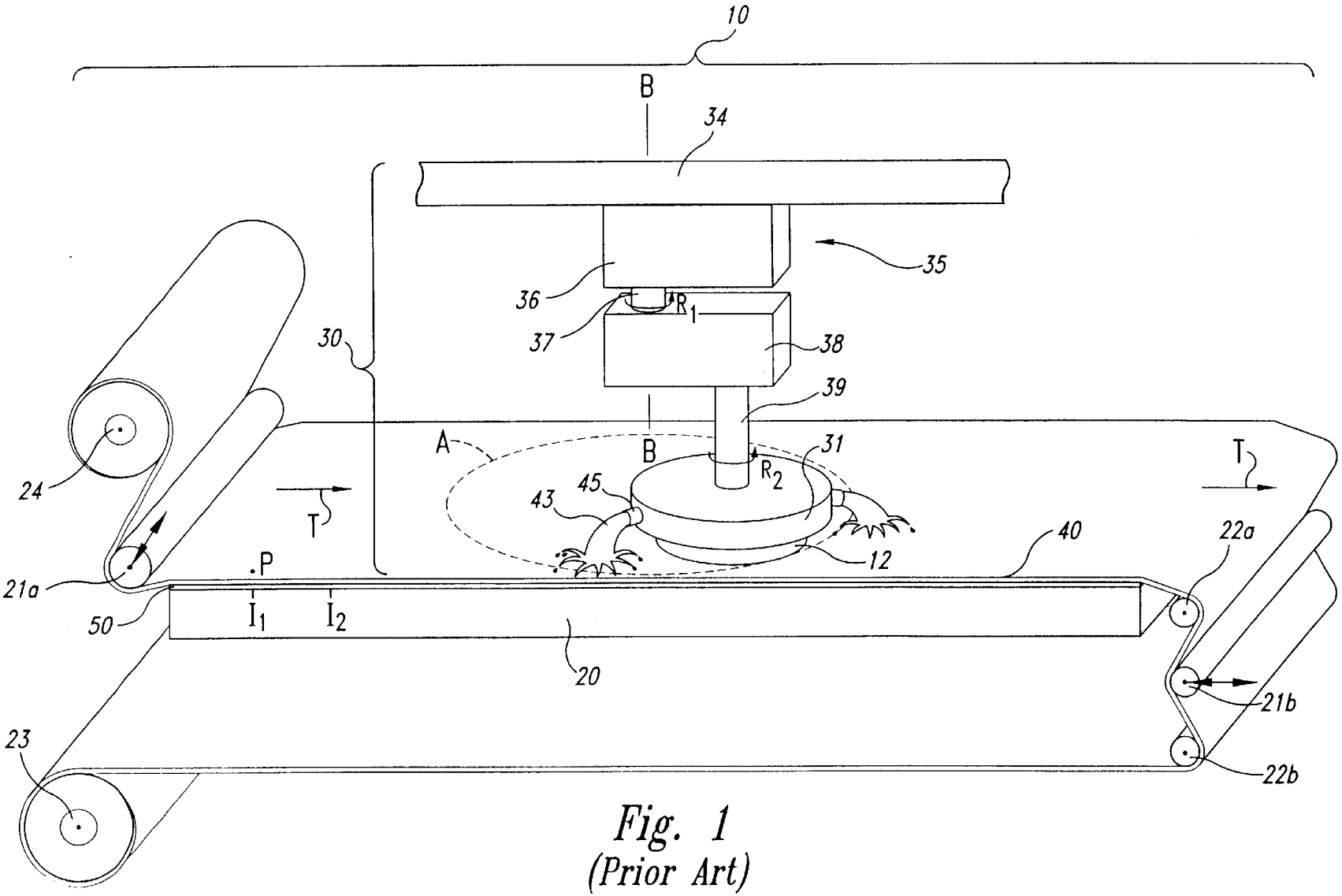
Fig. 1 (Prior Art)
FIG. 1 is a partially schematic, front isometric view of a web-format planarizing machine in accordance with the prior art.
Figure 2:
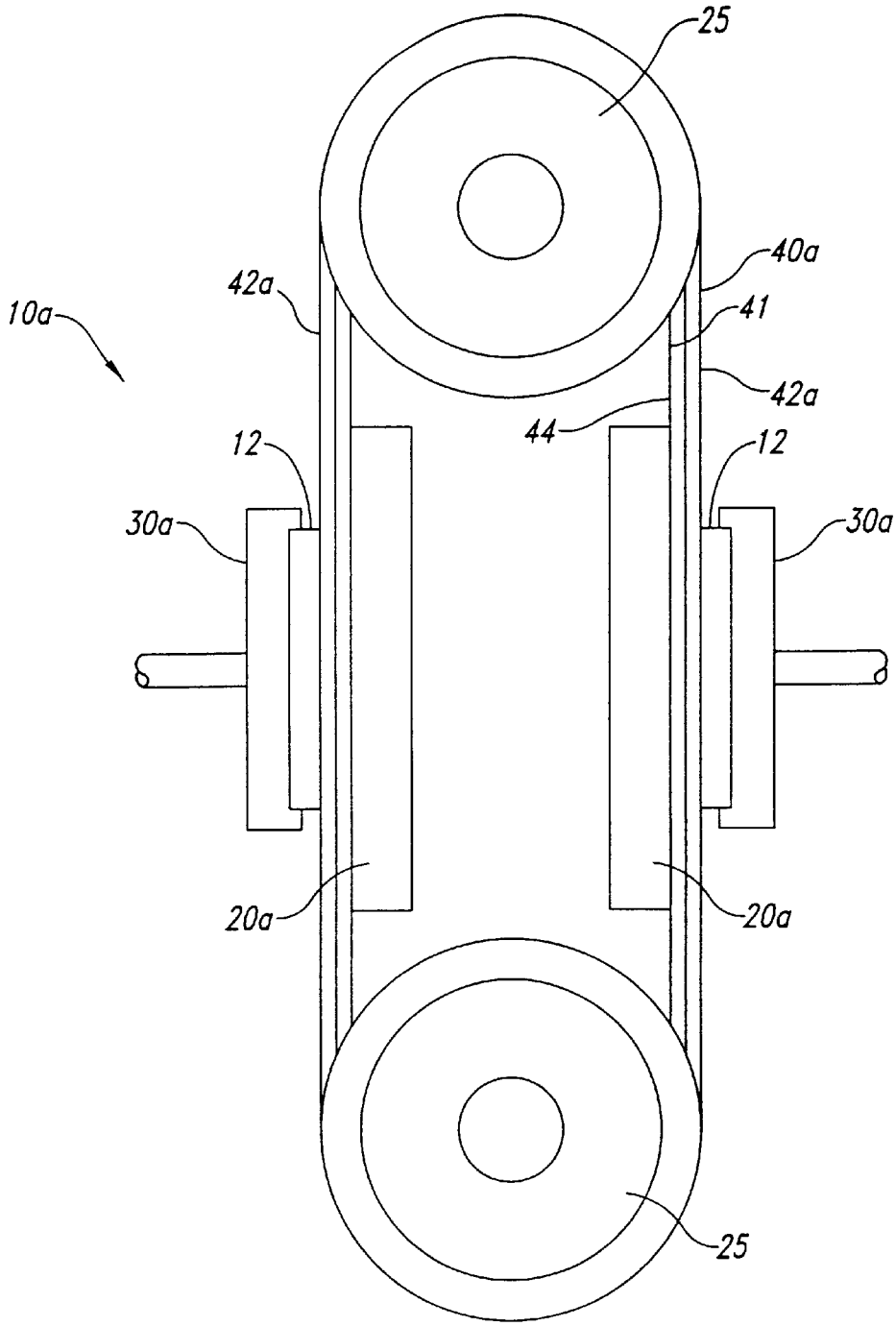
Fig. 2 (Prior Art)
FIG. 2 is a partially schematic, side elevation view of a planarizing machine having a continuous polishing pad in accordance with the prior art.

Yet another feature of the apparatus 110 is that the cleaning device 170 can reduce the likelihood for contaminants to become lodged between the polishing pad 140 and the support pad 150, and the milling device 180 can increase the planarity of the support pad 150. Accordingly, the polishing pad 140 and the support pad 150 can be less likely to develop bulges or other non-uniformities that reduce the planarity of the planarizing surface 142 and therefore the substrate 112. Furthermore, should contaminants become trapped between the support pad 150 and the platen 120, the effect of such contaminants on the planarizing surface 142 can be reduced (compared to the effect of a contaminant trapped between a polishing pad and a support pad, such as is shown in FIG. 1) because the support pad 150 can either flex to accommodate the contaminant or distribute the effect of the contaminant over a large area.

Figure 5:
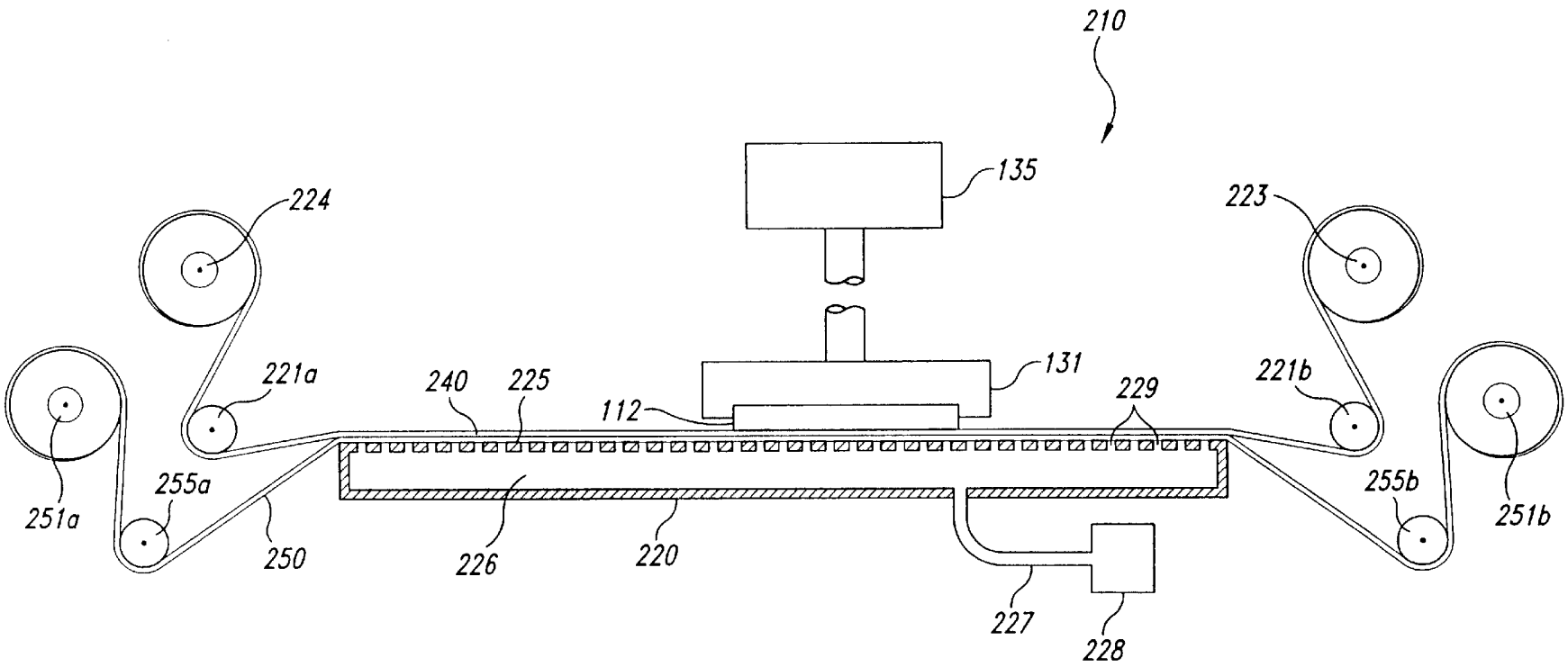
FIG. 5 is a partially schematic, side elevation view of a planarizing machine having a movable, non-continuous support pad in accordance with another embodiment of the invention.

FIG. 5 is a partially schematic, side elevation view of a planarizing apparatus 210 having a non-continuous support pad 250 that supports a polishing pad 240 in accordance with another embodiment of the invention. The polishing pad 240 can advance from a supply roller 224, past idler rollers 221*a*, 221*b* and to a take-up roller 223 in a manner generally similar to that discussed above with reference to FIGS. 3 and 4. The support pad 250 is initially wound on a first roller 251*a* and extends across a platen 220 to a second roller 251*b*. Support pad idler rollers 255*a* and 255*b* can tension the support pad 250 against a support surface 225 of the platen 220. Accordingly, the support pad 250 can unwind from the first roller 251*a* across the platen 220 and onto the second roller 251*b* in a manner generally similar to that discussed above with reference to the polishing pad 140 shown in FIGS. 3 and 4. In one aspect of this embodiment, the second roller 251*b* is powered to wind the support pad 250. Alternatively, both the first and second rollers 251 can be powered. In either case, the roller(s) 251 can advance the support pad 250 across the platen 220 at approximately the same rate as the polishing pad 240 advances across the platen 220.

In one embodiment, the support pad 250 can be disposed of once it is completely wound up on the second roller 251*b*. Alternatively, the support pad 250 can be rewound onto the first roller 251*a* and reused. In either case, the support pad 250 can have a length approximately the same as the length of the polishing pad 240 (in one embodiment), so that the polishing pad 240 and the support pad 250 become completely wound up on their respective rollers at approximately the same time. Accordingly, the polishing pad 240 and the support pad 250 can be changed or rewound at the same time.

In one embodiment, the platen 220 can include a manifold 226 having perforations or orifices 229 extending through the support surface 225 adjacent to the support pad 250. The manifold 226 can be coupled with a conduit 227 to a source of pressurized liquid or gas 228. In operation, the source 228 can supply liquid or gas to the manifold 226 and through the orifices 229 at a rate sufficient to separate at least a portion of the support pad 250 from the support surface 225. Accordingly, the size and spacing of the orifices 227 and the pressure of the fluid from the source 228 can be selected to separate the support pad 250 from the support surface 225 by a selected amount. An advantage of this feature is that it can reduce the friction between the support pad 250 and the platen 220 as the support pad 250 advances across the platen 220. In an alternate arrangement, suitable for an apparatus having a fixed support pad such as the one shown in FIG. 1, the support pad can have orifices aligned with the orifices of the manifold so that the pressurized liquid or gas can separate the polishing pad from the support pad.

Another feature of the apparatus 210 is that the non-continuous support pad 250 can include relatively inexpensive materials so that the support pad 250 can be economically replaced at the same time as the polishing pad 240. Conversely, a feature of the continuous support pad 150 (FIGS. 3 and 4) is that it can last through several polishing pads 140 and/or several cycles of a single polishing pad 140.

Figure 6:
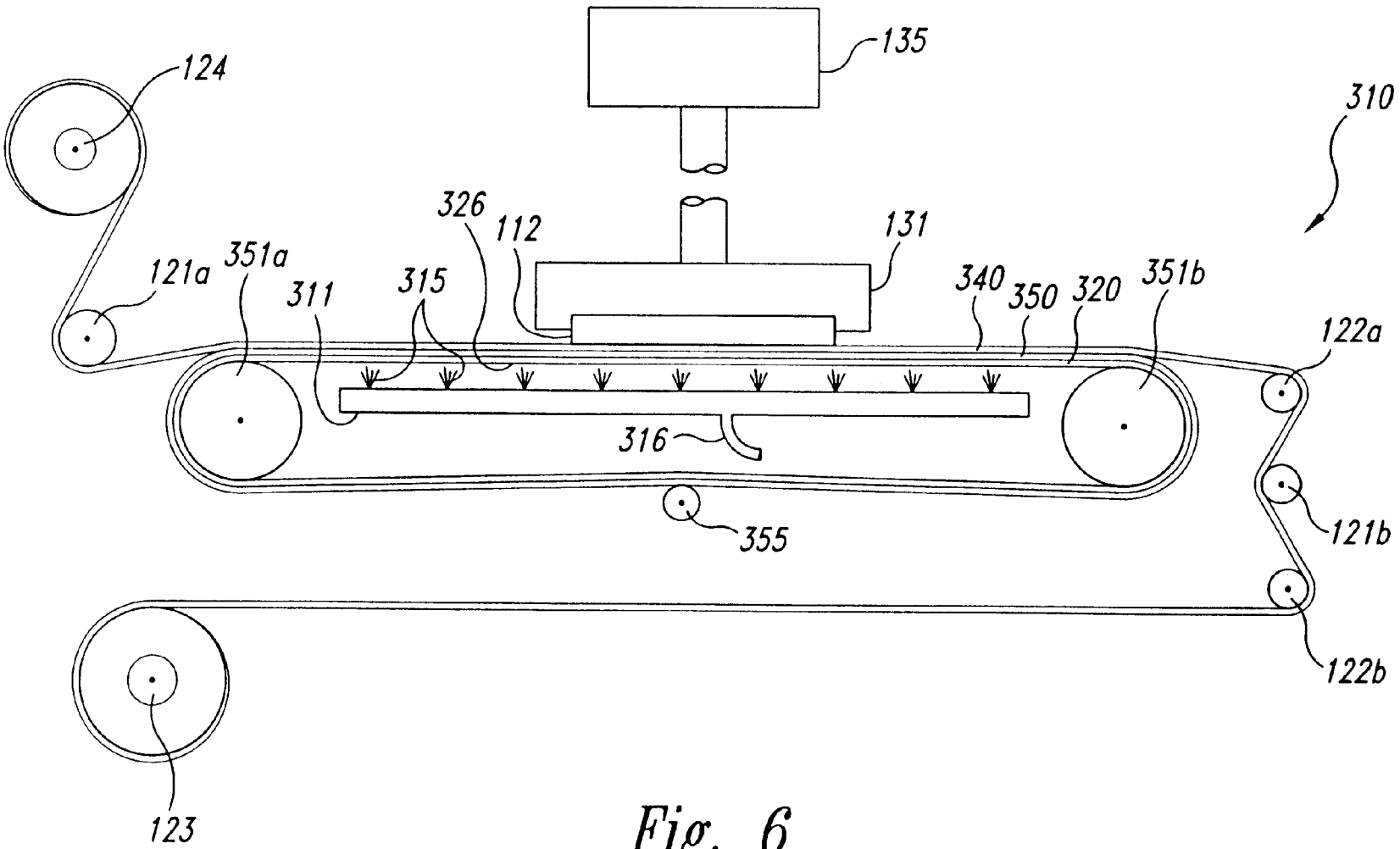
FIG. 6 is a partially schematic, side elevation view of a planarizing machine having a support pad coupled to a movable platen in accordance with yet another embodiment of the invention.

FIG. 6 is a partially schematic, side elevation view of an apparatus 310 having a continuous support pad 350 integrated with a continuous platen 320 in accordance with another embodiment of the invention. The continuous support pad 350 can include materials generally similar to those discussed above with reference to FIGS. 3 and 4 and can move into and out of engagement with a polishing pad 340 in a manner generally similar to that discussed above with reference to FIGS. 3 and 4. The platen 320 can include a continuous loop formed from a generally incompressible, relatively flexible material, such as a thin stainless steel sheet and can carry the support pad 350 over and around support pad rollers 351 (shown as a left support pad roller 351*a* and a right support pad roller 351*b*).

In one embodiment, the support pad 350 and the platen 320 can be tensioned over the support pad rollers 351 by a tensioning device, such as an idler roller 355 that presses upwardly against the lower leg of the loop formed by the support pad 350 and the platen 320. Alternatively, other devices can provide a flat surface that supports the polishing pad 340. For example, in one embodiment, the apparatus 310 can include a manifold 311 having a plurality of jet orifices 315 directed upwardly toward a back side 326 of the upper leg of the loop. The manifold 311 can be coupled to a conduit 316, which is in turn coupled to a source of pressurized fluid, such as pressurized water or pressurized air which is forced through the orifices 315 to tension the platen 320 and the support pad 350. Alternatively, the manifold 311 can be positioned adjacent the lower leg of the loop (at approximately the location of the idler roller 355) with the jet orifices 315 directed upwardly against the lower leg in addition to or in lieu of the idler roller 355. An advantage of tensioning the lower leg is that the upper leg is less likely to bow upwardly.

One feature of the apparatus 310 shown in FIG. 6 is that it eliminates relative motion between the support pad 350 and the platen 320. Accordingly, an advantage of the apparatus 310 is that it can reduce the wear on the support pad 350, which can increase the life of the support pad 350 and reduce the frequency with which the support pad 350 may need to be replaced. A further advantage is that by integrating the support pad 350 with the platen 320, the apparatus 310 can eliminate the possibility for contaminants to become caught between the support pad 350 and the platen 320, further reducing the likelihood that contaminants can reduce the planarity of the polishing pad 340.

Figure 7:
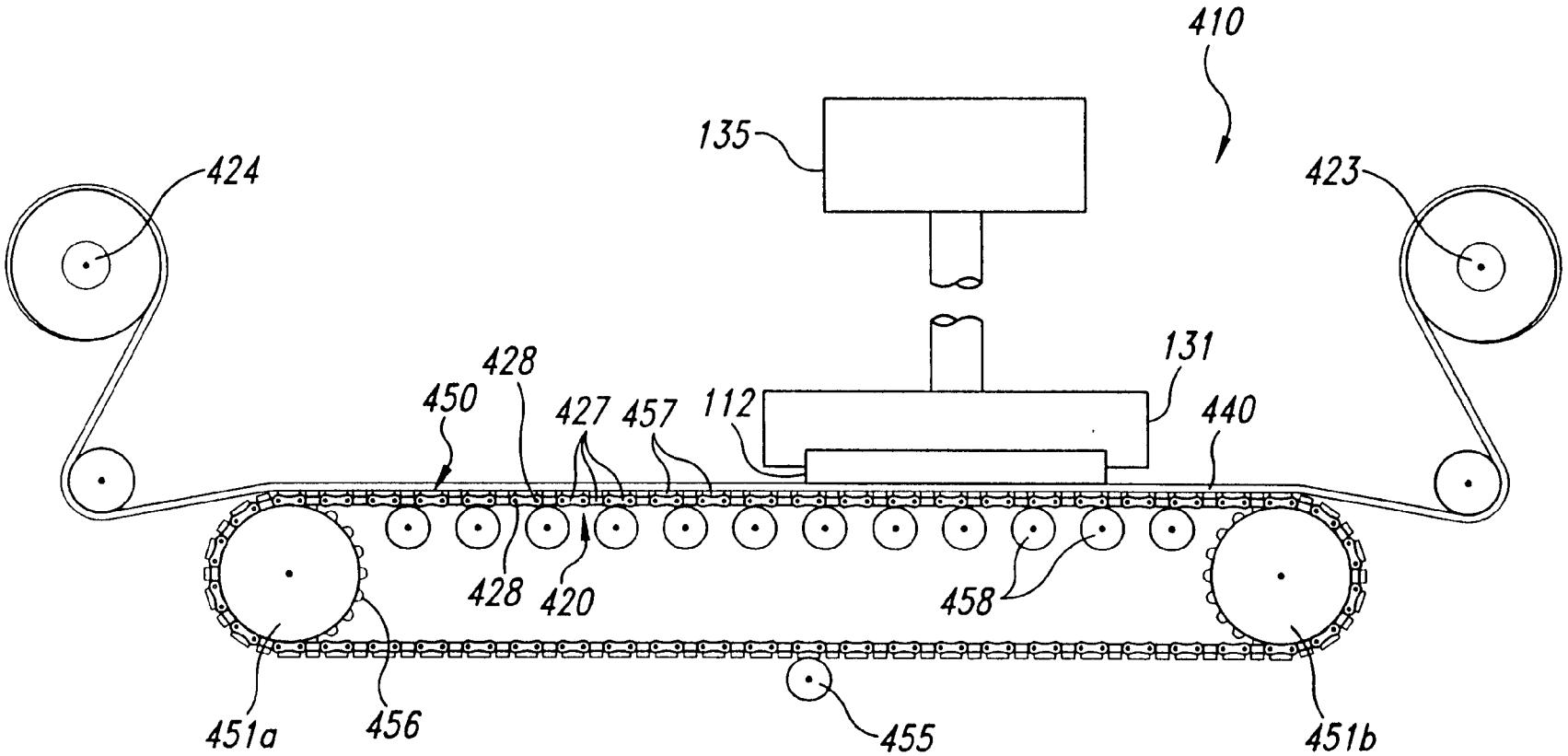
FIG. 7 is a partially schematic, side elevation view of a planarizing machine having a segmented platen in accordance with still another embodiment of the invention.

FIG. 7 is a partially schematic, side elevation view of an apparatus 410 having a segmented platen 420 connected to a support pad 450, both of which support a polishing pad 440 in accordance with another embodiment of the invention. The platen 420 can include a plurality of links 427 pivotally coupled to each other with pins 428 to form a continuous loop extending around two rollers 451 (shown as a left roller 451*a* and a right roller 451*b*) generally in the manner of a chain or tank trend. In one aspect of this embodiment, the rollers 451 can each include teeth 456 to engage the links 427 and align the links 427 as they pass over the rollers 451. Alternatively, the platen 420 can include other segmented arrangements and the roller can include other corresponding features for guiding the platen 420.

In one embodiment, the apparatus 410 can also include a plurality of support rollers 458 positioned between the rollers 451 along the upper leg of the loop formed by the platen 420 and support pad 450 to support the platen 420 and the support pad 450 in the region between the rollers 451. An idler roller 455 can be positioned adjacent the lower leg of the loop to bias the platen 420 and the support pad 450 upwardly and tension these components relative to the rollers 451, either in addition to or in lieu of the support rollers 458.

In one embodiment, the support pad 450 can include a plurality of segments 457, each separately attached to one of the links 427. The segments 457 can be closely spaced to provide a nearly continuous support surface for the polishing pad 440. Alternatively, the support pad 450 can be continuous, for example, by making the connection between the support pad 450 and the links 427 flexible and/or making the support pad 450 itself flexible, so that the support pad 450 can bend around the rollers 451. In yet another alternate embodiment, both the polishing pad 440 and the support pad 450 can be elongated, noncontinuous pads that extend between corresponding supply rollers and take-up rollers, generally as discussed above with reference to FIG. 5. Accordingly, the support pad 450 can be removed and/or replaced without removing the platen 420. In any case, the support pad 450 can engage with and disengage from the polishing pad 440 (which unwinds from a supply roll 424 and winds up onto a take-up roller 423) in a manner generally similar to that discussed above with reference to FIGS. 3 and 4.

Figure 8:
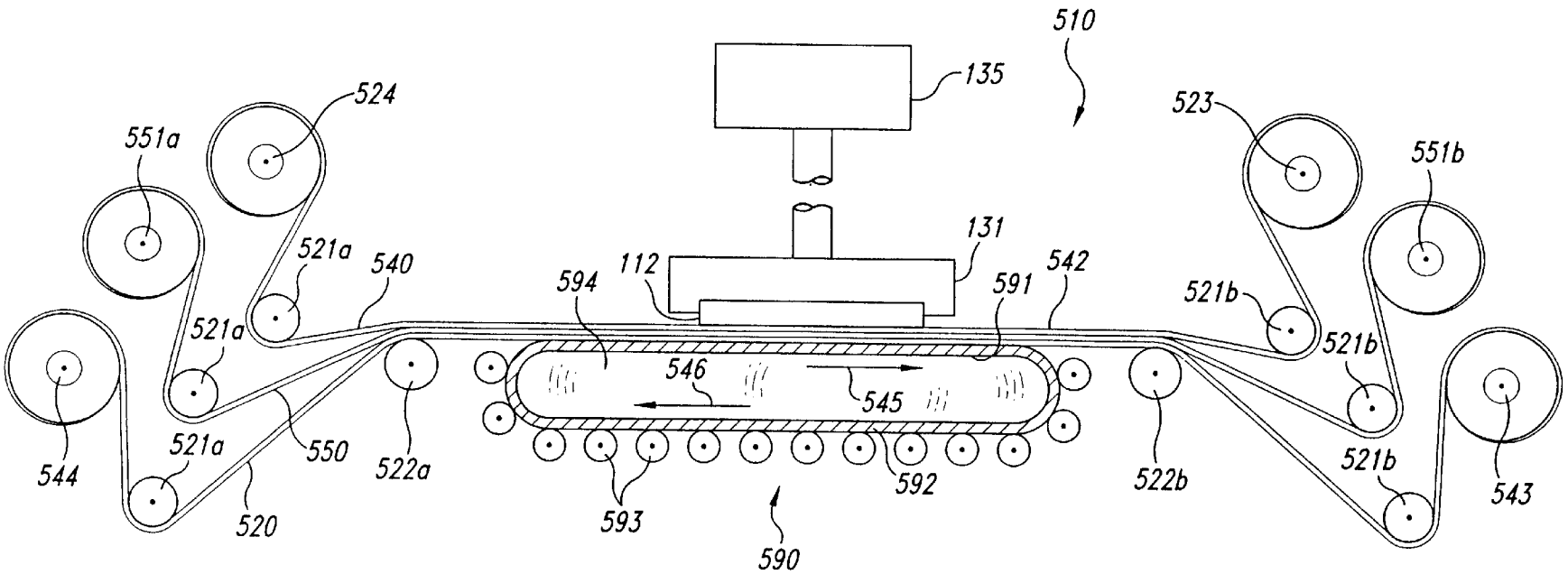
FIG. 8 is a partially schematic, partial cross-sectional side elevation view of a planarizing machine having a movable, non-continuous platen supported by a rotating bladder in accordance with another embodiment of the invention.

FIG. 8 is a partially schematic, partial cross-sectional side elevation view of a planarizing machine 510 having a movable, non-continuous platen 520 supported by a rotating bladder 590 in accordance with another embodiment of the invention. The bladder 590 can be formed from an at least partially fluid tight membrane folded upon itself to define an interior region 594 filled with a fluid, such as water or air. The bladder 590 has a cross-sectional shape that forms a loop having an upper leg 591 adjacent the platen 520 and a lower leg 592 opposite the upper leg 591. The upper leg 591 can support the platen 520 and can move from left to right as indicated by arrow 545 along with the platen 520 as the platen 520 unwinds from a supply roller 544 to a take-up roller 543. The lower leg 592 of the bladder 590 can move from right to left as indicated by arrow 546 and can be supported by a plurality of bladder rollers 593 that rotatably engage the lower leg 592. Accordingly, the bladder 590 can bias the platen 520 to a flat position while minimizing abrasive contact between the platen 520 and the bladder 590 because the two move at the same rate when they are in contact with each other.

In one embodiment, the apparatus 510 can further include a noncontinuous support pad 550 that unwinds from a supply roller 551*a* and winds up onto a take-up roller 551*b*. The apparatus 510 can further include a noncontinuous polishing pad 540 that extends from a supply roller 524 to a take-up roller 523. The platen 520, the support pad 550 and the polishing pad 540 can each pass over separate left idler rollers 521*a* and right idler rollers 521*b* and can come together over a left guide roller 522*a* before passing over the bladder 590. After passing over the bladder 590, the platen 520, the support pad 550 and the polishing pad 540 can pass over a right guide roller 522*b*, from which the platen 520, the support pad 550 and the polishing pad 540 diverge.

In an alternate arrangement, the platen 520 can form a continuous loop that extends annularly around the bladder 590. In a further aspect of this embodiment, the support pad 550 can be integrated with the platen 520, in a manner similar to that discussed above with reference to FIGS. 6 or 7. In any case, one feature of the apparatus 510 is that the polishing pad 540, the support pad 550, the platen 520, and the bladder 590 each move at approximately the same linear rate when they are in contact with each other. Accordingly, the likelihood for abrasion between these components (which can reduce the expected service life of the components), can be significantly reduced in comparison to some conventional devices.

The apparatus 510 can also include a cleaning device (such as the devices 170 discussed above with reference to FIG. 4) and/or a milling device (such as the device 180 discussed above with reference to FIG. 4) positioned between the polishing pad 540 and the support pad 550, the support pad 550 and the platen 520, and/or the platen 520 and the bladder 590. Accordingly, another feature of the arrangement shown in FIG. 8 is that the likelihood for contaminants to become caught between the polishing pad 540, the support pad 550 and/or the platen 520 can be reduced in comparison to some to conventional devices, reducing the likelihood for creating non-uniformities at the planarizing surface 542 and at the surface of the substrate 112.

From the foregoing it will be appreciated that, although specific embodiments of the invention have been described herein for purposes of illustration, various modifications may be made without deviating from the spirit and scope of the invention. For example, certain features shown in the context of one embodiment of the invention may be incorporated in other embodiments as well. For instance, the cleaning devices 170 and the milling device 180 shown in FIG. 4 may be used in connection with any of the planarizing machines shown in FIGS. 5–8. The perforated platen 220 shown in FIG. 5 can be used in conjunction with the support pad 150 and polishing pad 140 shown in FIGS. 3 and 4. Any of the platen tensioning arrangements shown in FIGS. 6–8 can be used with any of the flexible or segmented platens shown in these Figures to provide a flat support surface. Accordingly, the invention is not limited except as by the appended claims.

What is claimed is:

1. An apparatus for planarizing a microelectronic substrate, comprising:

a platen having a support surface;

an elongated polishing pad moveable relative to at least a portion of the platen between a first position with a portion of the polishing pad aligned with and facing toward at least a portion of the support surface of the platen and a second position with the portion of the polishing pad out of alignment and facing at least partially away from the support surface of the platen; and an elongated support pad movable with the polishing pad between a first position with a portion of the support pad in contact with the portion of the polishing pad and a second position with the portion of the support pad out of contact with the portion of the polishing pad, wherein the platen includes an elongated flexible member attached to the support pad and movable with the support pad.

2. The apparatus of claim 1 wherein the support pad is elongated along an axis and is compressible in a direction generally perpendicular to the axis.

3. The apparatus of claim 1 wherein the polishing pad extends between a supply roll and a take-up roll.

4. The apparatus of claim 1, further comprising a first roller positioned proximate to the platen and a second roller spaced apart from the first roller, wherein the support pad forms a continuous loop extending around the first and second rollers.

5. An apparatus for planarizing a microelectronic substrate, comprising:

a platen having a support surface;

an elongated polishing pad moveable relative to at least a portion of the platen between a first position with a portion of the polishing pad aligned with and facing toward at least a portion of the support surface of the platen and a second position with the portion of the polishing pad out of alignment and facing at least partially away from the support surface of the platen; and an elongated support pad movable with the polishing pad between a first position with a portion of the support pad in contact with the portion of the polishing pad and a second position with the portion of the support pad out of contact with the portion of the polishing pad, wherein the platen is movable relative to the support pad between a first position with a portion of the platen in contact with the support pad and a second position with the portion of the platen separated from the support pad.

6. The apparatus of claim 5 wherein the support pad is elongated along an axis and is compressible in a direction generally perpendicular to the axis.

7. The apparatus of claim 5 wherein the polishing pad extends between a supply roll and a take-up roll.

8. The apparatus of claim 5, further comprising a first roller positioned proximate to the platen and a second roller spaced apart from the first roller, wherein the support pad forms a continuous loop extending around the first and second rollers.

9. An apparatus for planarizing a microelectronic substrate, comprising:

a platen having a support surface;

an elongated polishing pad moveable relative to at least a portion of the platen between a first position with a portion of the polishing pad aligned with and facing toward at least a portion of the support surface of the platen and a second position with the portion of the polishing pad out of alignment and facing at least partially away from the support surface of the platen; and an elongated support pad movable with the polishing pad between a first position with a portion of the support pad in contact with the portion of the polishing pad and a second position with the portion of the support pad out of contact with the portion of the polishing pad, wherein the platen is movable relative to the support pad between a first position with a portion of the platen in contact with the support pad and a second position with the portion of the platen separated from the support pad, the apparatus further comprising a platen supply roller and a platen take-up roller spaced apart from the platen supply roller, wherein the platen is elongated between a first end coupled to the platen supply roller and a second end coupled to the platen take-up roller.

10. The apparatus of claim 9 wherein the support pad is elongated along an axis and is compressible in a direction generally perpendicular to the axis.

11. The apparatus of claim 9 wherein the polishing pad extends between a supply roll and a take-up roll.

12. The apparatus of claim 9, further comprising a first roller positioned proximate to the platen and a second roller spaced apart from the first roller, wherein the support pad forms a continuous loop extending around the first and second rollers.

13. An apparatus for planarizing a microelectronic substrate, comprising:

a platen having a support surface;

an elongated polishing pad moveable relative to at least a portion of the platen between a first position with a portion of the polishing pad aligned with and facing toward at least a portion of the support surface of the platen and a second position with the portion of the polishing pad out of alignment and facing at least partially away from the support surface of the platen; and an elongated support pad movable with the polishing pad between a first position with a portion of the support pad in contact with the portion of the polishing pad and a second position with the portion of the support pad out of contact with the portion of the polishing pad, wherein the platen is movable relative to the support pad between a first position with a portion of the platen in contact with the support pad and a second position with the portion of the platen separated from the support pad, and further wherein the platen includes a plurality of links pivotably coupled together to form a continuous loop, and the support pad includes a plurality of adjacent separable support pad portions, each support pad portion being attached to one of the links of the platen.

14. The apparatus of claim 13 wherein the support pad is elongated along an axis and is compressible in a direction generally perpendicular to the axis.

15. The apparatus of claim 13 wherein the polishing pad extends between a supply roll and a take-up roll.

16. An apparatus for planarizing a microelectronic substrate, comprising:

a platen having a support surface;

an elongated polishing pad moveable relative to at least a portion of the platen between a first position with a portion of the polishing pad aligned with and facing toward at least a portion of the support surface of the platen and a second position with the portion of the polishing pad out of alignment and facing at least partially away from the support surface of the platen; and an elongated support pad movable with the polishing pad between a first position with a portion of the support pad in contact with the portion of the polishing pad and a second position with the portion of the support pad out of contact with the portion of the polishing pad, wherein the platen is movable relative to the support pad between a first position with a portion of the platen in contact with the support pad and a second position with the portion of the platen separated from the support pad, wherein the platen includes a plurality of links pivotably coupled together to form a continuous loop, and having a plurality of rollers rotatably engaged with the links of the platen for supporting the platen and the support pad, and further wherein the support pad includes a plurality of adjacent separable support pad portions, each support pad portion being attached to one of the links of the platen.

17. The apparatus of claim 16 wherein the support pad is elongated along an axis and is compressible in a direction generally perpendicular to the axis.

18. The apparatus of claim 16 wherein the polishing pad extends between a supply roll and a take-up roll.

19. An apparatus for planarizing a microelectronic substrate, comprising:

a platen having a support surface;

an at least partially fluid tight bladder having a cross-sectional shape that defines a loop with a first portion and a second portion, the first portion of the loop being in contact with and supporting the platen;

a plurality of rollers rotatably engaged with the second portion of the loop;

an elongated polishing pad moveable relative to at least a portion of the platen between a first position with a portion of the polishing pad aligned with and facing toward at least a portion of the support surface of the platen and a second position with the portion of the polishing pad out of alignment and facing at least partially away from the support surface of the platen; and an elongated support pad movable with the polishing pad between a first position with a portion of the support pad in contact with the portion of the polishing pad and a second position with the portion of the support pad out of contact with the portion of the polishing pad, wherein the platen is movable relative to the support pad between a first position with a portion of the platen in contact with the support pad and a second position with the portion of the platen separated from the support pad.

20. The apparatus of claim 19 wherein the support pad is elongated along an axis and is compressible in a direction generally perpendicular to the axis.

21. The apparatus of claim 19 wherein the polishing pad extends between a supply roll and a take-up roll.

22. The apparatus of claim 19, further comprising a first roller positioned proximate to the platen and a second roller spaced apart from the first roller, wherein the support pad forms a continuous loop extending around the first and second rollers.

23. The apparatus of claim 19, further comprising a pad supply roller and a pad take-up roller spaced apart from the pad supply roller, wherein the support pad is elongated between a first end coupled to the pad supply roller and a second end coupled to the pad take-up roll.

24. An apparatus for planarizing a microelectronic substrate, comprising:

a platen having a support surface;

an elongated polishing pad moveable relative to at least a portion of the platen between a first position with a portion of the polishing pad aligned with and facing toward at least a portion of the support surface of the platen and a second position with the portion of the polishing pad out of alignment and facing at least partially away from the support surface of the platen; and an elongated support pad movable with the polishing pad between a first position with a portion of the support pad in contact with the portion of the polishing pad and a second position with the portion of the support pad out of contact with the portion of the polishing pad, the apparatus further comprising a cleaning device positioned proximate to an interface between the portion of the polishing pad and the portion of the support pad to remove material from at least one of the polishing pad and the support pad.

25. The apparatus of claim 24 wherein the support pad is elongated along an axis and is compressible in a direction generally perpendicular to the axis.

26. The apparatus of claim 24 wherein the polishing pad extends between a supply roll and a take-up roll.

27. The apparatus of claim 24, further comprising a first roller positioned proximate to the platen and a second roller spaced apart from the first roller, wherein the support pad forms a continuous loop extending around the first and second rollers.

28. An apparatus for planarizing a microelectronic substrate, comprising:

a platen having a support surface;

an elongated polishing pad moveable relative to at least a portion of the platen between a first position with a portion of the polishing pad aligned with and facing toward at least a portion of the support surface of the platen and a second position with the portion of the polishing pad out of alignment and facing at least partially away from the support surface of the platen; and an elongated support pad movable with the polishing pad between a first position with a portion of the support pad in contact with the portion of the polishing pad and a second position with the portion of the support pad out of contact with the portion of the polishing pad, the apparatus further comprising a cleaning device positioned proximate to an interface between the portion of the polishing pad and the portion of the support pad to remove material from at least one of the polishing pad and the support pad, wherein the cleaning device is selected from a source of pressurized gas, a source of pressurized liquid, a vacuum source and a brush.

29. The apparatus of claim 28 wherein the support pad is elongated along an axis and is compressible in a direction generally perpendicular to the axis.

30. The apparatus of claim 28 wherein the polishing pad extends between a supply roll and a take-up roll.

31. The apparatus of claim 28, further comprising a first roller positioned proximate to the platen and a second roller spaced apart from the first roller, wherein the support pad forms a continuous loop extending around the first and second rollers.

32. An apparatus for planarizing a microelectronic substrate, comprising:

a platen having a support surface;

an elongated polishing pad moveable relative to at least a portion of the platen between a first position with a portion of the polishing pad aligned with and facing toward at least a portion of the support surface of the platen and a second position with the portion of the polishing pad out of alignment and facing at least partially away from the support surface of the platen; and an elongated support pad movable with the polishing pad between a first position with a portion of the support pad in contact with the portion of the polishing pad and a second position with the portion of the support pad out of contact with the portion of the polishing pad, the apparatus further comprising a cleaning device positioned proximate to an interface between the portion of the polishing pad and the portion of the support pad to remove material from at least one of the polishing pad and the support pad, and further wherein the support pad has a first surface and a second surface facing opposite the first surface, further wherein the cleaning device is positioned adjacent both surfaces of the support pad for cleaning the one surface.

33. The apparatus of claim 32 wherein the support pad is elongated along an axis and is compressible in a direction generally perpendicular to the axis.

34. The apparatus of claim 32 wherein the polishing pad extends between a supply roll and a take-up roll.

35. The apparatus of claim 32, further comprising a first roller positioned proximate to the platen and a second roller spaced apart from the first roller, wherein the support pad forms a continuous loop extending around the first and second rollers.

36. An apparatus for planarizing a microelectronic substrate, comprising:

a platen having a support surface;

an elongated polishing pad moveable relative to at least a portion of the platen between a first position with a portion of the polishing pad aligned with and facing toward at least a portion of the support surface of the platen and a second position with the portion of the polishing pad out of alignment and facing at least partially away from the support surface of the platen; and an elongated support pad movable with the polishing pad between a first position with a portion of the support pad in contact with the portion of the polishing pad and a second position with the portion of the support pad out of contact with the portion of the polishing pad, the apparatus further comprising a milling device positioned proximate to the support pad and having at least one sharpened engaging surface positioned to remove a selected amount of support pad material from the support pad.

37. The apparatus of claim 36 wherein the support pad is elongated along an axis and is compressible in a direction generally perpendicular to the axis.

38. The apparatus of claim 36 wherein the polishing pad extends between a supply roll and a take-up roll.

39. The apparatus of claim 36, further comprising a first roller positioned proximate to the platen and a second roller spaced apart from the first roller, wherein the support pad forms a continuous loop extending around the first and second rollers.

40. An apparatus for planarizing a microelectronic substrate, comprising:

a platen having a support surface;

an elongated polishing pad moveable relative to at least a portion of the platen between a first position with a portion of the polishing pad aligned with and facing toward at least a portion of the support surface of the platen and a second position with the portion of the polishing pad out of alignment and facing at least partially away from the support surface of the platen; and an elongated support pad movable with the polishing pad between a first position with a portion of the support pad in contact with the portion of the polishing pad and a second position with the portion of the support pad out of contact with the portion of the polishing pad, the apparatus further comprising a cleaning device positioned proximate to an interface between the portion of the polishing pad and the portion of the support pad to remove material from at least one of the polishing pad and the support pad, the support pad having a first surface and a second surface facing opposite the first surface, and a cleaning device positioned adjacent both surfaces of the support pad for cleaning both the first and second surfaces, the apparatus further comprising a milling device positioned to remove material from both the first and second surfaces of the support pad.

41. The apparatus of claim 40 wherein the support pad is elongated along an axis and is compressible in a direction generally perpendicular to the axis.

42. The apparatus of claim 40 wherein the polishing pad extends between a supply roll and a take-up roll.

43. The apparatus of claim 40, further comprising a first roller positioned proximate to the platen and a second roller spaced apart from the first roller, wherein the support pad forms a continuous loop extending around the first and second rollers.

44. An apparatus for planarizing a microelectronic substrate, comprising:

a platen having a support surface;

an elongated polishing pad moveable relative to at least a portion of the platen between a first position with a portion of the polishing pad aligned with and facing toward at least a portion of the support surface of the platen and a second position with the portion of the polishing pad out of alignment and facing at least partially away from the support surface of the platen, wherein the polishing pad is coupled to an actuator to move at a selected rate between the first position and the second position, further wherein the support pad is engaged with the polishing pad to move with the polishing pad at the selected rate; and an elongated support pad movable with the polishing pad between a first position with a portion of the support pad in contact with the portion of the polishing pad and a second position with the portion of the support pad out of contact with the portion of the polishing pad.

45. The apparatus of claim 44 wherein the support pad is elongated along an axis and is compressible in a direction generally perpendicular to the axis.

46. The apparatus of claim 44 wherein the polishing pad extends between a supply roll and a take-up roll.

47. The apparatus of claim 44, further comprising a first roller positioned proximate to the platen and a second roller spaced apart from the first roller, wherein the support pad forms a continuous loop extending around the first and second rollers.

48. The apparatus of claim 44, further comprising a pad supply roller and a pad take-up roller spaced apart from the pad supply roller, wherein the support pad is elongated between a first end coupled to the pad supply roller and a second end coupled to the pad take-up roll.

49. An apparatus for planarizing a microelectronic substrate, comprising:

a platen having a support surface;

an elongated polishing pad moveable relative to at least a portion of the platen between a first position with a portion of the polishing pad aligned with and facing toward at least a portion of the support surface of the platen and a second position with the portion of the polishing pad out of alignment and facing at least partially away from the support surface of the platen; and an elongated support pad movable with the polishing pad between a first position with a portion of the support pad in contact with the portion of the polishing pad and a second position with the portion of the support pad out of contact with the portion of the polishing pad, wherein the support surface of the platen has a plurality of orifices coupleable to a source of pressurized fluid for introducing the fluid between the support surface and the support pad to at least partially separate the support pad from the support surface.

50. The apparatus of claim 49 wherein the support pad is elongated along an axis and is compressible in a direction generally perpendicular to the axis.

51. The apparatus of claim 49 wherein the polishing pad extends between a supply roll and a take-up roll.

52. The apparatus of claim 49, further comprising a first roller positioned proximate to the platen and a second roller spaced apart from the first roller, wherein the support pad forms a continuous loop extending around the first and second rollers.

53. The apparatus of claim 49, further comprising a pad supply roller and a pad take-up roller spaced apart from the pad supply roller, wherein the support pad is elongated between a first end coupled to the pad supply roller and a second end coupled to the pad take-up roll.

54. An apparatus for planarizing a microelectronic substrate, comprising:

a platen having a support surface;

an elongated polishing pad moveable relative to at least a portion of the platen to move a first portion of the polishing pad into alignment with the support surface of the platen and move a second portion of the polishing pad spaced apart from the first portion out of alignment with the support surface of the platen; and a support pad positioned partially between the polishing pad and the platen, the support pad being movable with the polishing pad and having a first portion in contact with the first portion of the polishing pad when the first portion of the polishing pad is aligned with the platen, the support pad further having a second portion out of contact with the polishing pad when the second portion of the polishing pad is out of alignment with the platen, wherein the platen is movable relative to the support pad between a first position with a portion of the platen in contact with the support pad and a second position with the portion of the platen separated from the support pad.

55. The apparatus of claim 54 wherein the polishing pad extends between a supply roller and a take-up roller.

56. The apparatus of claim 54, further comprising a pad supply roller and a pad take-up roller spaced apart from the pad supply roller, wherein the support pad is elongated between a first end coupled to the pad supply roller and a second end coupled to the pad take-up roller.

57. An apparatus for planarizing a microelectronic substrate, comprising:

a platen having a support surface;

an elongated polishing pad moveable relative to at least a portion of the platen to move a first portion of the polishing pad into alignment with the support surface of the platen and move a second portion of the polishing pad spaced apart from the first portion out of alignment with the support surface of the platen; and a support pad positioned partially between the polishing pad and the platen, the support pad being movable with the polishing pad and having a first portion in contact with the first portion of the polishing pad when the first portion of the polishing pad is aligned with the platen, the support pad further having a second portion out of contact with the polishing pad when the second portion of the polishing pad is out of alignment with the platen, wherein the platen includes an elongated flexible member attached to the support pad and movable with the support pad.

58. The apparatus of claim 57 wherein the polishing pad extends between a supply roller and a take-up roller.

59. The apparatus of claim 57, further comprising a first roller positioned proximate to the platen and a second roller spaced apart from the first roller, wherein the support pad forms a continuous loop extending around the first and second rollers.

60. The apparatus of claim 57, further comprising a pad supply roller and a pad take-up roller spaced apart from the pad supply roller, wherein the support pad is elongated between a first end coupled to the pad supply roller and a second end coupled to the pad take-up roller.

61. An apparatus for planarizing a microelectronic substrate, comprising:

a platen having a support surface;

an elongated polishing pad moveable relative to at least a portion of the platen to move a first portion of the polishing pad into alignment with the support surface of the platen and move a second portion of the polishing pad spaced apart from the first portion out of alignment with the support surface of the platen; and a support pad positioned partially between the polishing pad and the platen, the support pad being movable with the polishing pad and having a first portion in contact with the first portion of the polishing pad when the first portion of the polishing pad is aligned with the platen, the support pad further having a second portion out of contact with the polishing pad when the second portion of the polishing pad is out of alignment with the platen, wherein the platen includes a plurality of links coupled together to form a continuous loop, further wherein the support pad includes an elongated flexible member attached to the links of the platen.

62. The apparatus of claim 61 wherein the polishing pad extends between a supply roller and a take-up roller.

63. An apparatus for planarizing a microelectronic substrate, comprising:

a platen having a support surface;

an elongated polishing pad moveable relative to at least a portion of the platen to move a first portion of the polishing pad into alignment with the support surface of the platen and move a second portion of the polishing pad spaced apart from the first portion out of alignment with the support surface of the platen; and a support pad positioned partially between the polishing pad and the platen, the support pad being movable with the polishing pad and having a first portion in contact with the first portion of the polishing pad when the first portion of the polishing pad is aligned with the platen, the support pad further having a second portion out of contact with the polishing pad when the second portion of the polishing pad is out of alignment with the platen, the platen including a plurality of segmented links coupled together to form a continuous loop, and a plurality of rollers rotatably engaged with the segmented links of the platen for supporting the platen and the support pad, the support pad further including an elongated flexible member attached to the links of the platen.

64. The apparatus of claim 63 wherein the polishing pad extends between a supply roller and a take-up roller.

65. An apparatus for planarizing a microelectronic substrate, comprising:

a platen having a support surface;

an elongated polishing pad moveable relative to at least a portion of the platen to move a first portion of the polishing pad into alignment with the support surface of the platen and move a second portion of the polishing pad spaced apart from the first portion out of alignment with the support surface of the platen; and a support pad positioned partially between the polishing pad and the platen, the support pad being movable with the polishing pad and having a first portion in contact with the first portion of the polishing pad when the first portion of the polishing pad is aligned with the platen, the support pad further having a second portion out of contact with the polishing pad when the second portion of the polishing pad is out of alignment with the platen, the apparatus, further comprising a cleaning device positioned adjacent an interface of the first portion of the polishing pad and the first portion of the support pad to remove material from at least one of the polishing pad and the support pad.

66. The apparatus of claim 65 wherein the polishing pad extends between a supply roller and a take-up roller.

67. The apparatus of claim 65, further comprising a first roller positioned proximate to the platen and a second roller spaced apart from the first roller, wherein the support pad forms a continuous loop extending around the first and second rollers.

68. An apparatus for planarizing a microelectronic substrate, comprising:

a platen having a support surface;

an elongated polishing pad moveable relative to at least a portion of the platen to move a first portion of the polishing pad into alignment with the support surface of the platen and move a second portion of the polishing pad spaced apart from the first portion out of alignment with the support surface of the platen; and a support pad positioned partially between the polishing pad and the platen, the support pad being movable with the polishing pad and having a first portion in contact with the first portion of the polishing pad when the first portion of the polishing pad is aligned with the platen, the support pad further having a second portion out of contact with the polishing pad when the second portion of the polishing pad is out of alignment with the platen, the apparatus further comprising a cleaning device positioned adjacent an interface of the first portion of the polishing pad and the first portion of the support pad to remove material from at least one of the polishing pad and the support pad, wherein the cleaning device is selected from a source of pressurized gas, a source of pressurized liquid, a vacuum source and a brush.

69. The apparatus of claim 68 wherein the polishing pad extends between a supply roller and a take-up roller.

70. The apparatus of claim 68, further comprising a first roller positioned proximate to the platen and a second roller spaced apart from the first roller, wherein the support pad forms a continuous loop extending around the first and second rollers.

71. An apparatus for planarizing a microelectronic substrate, comprising:

a platen having a support surface;

an elongated polishing pad moveable relative to at least a portion of the platen to move a first portion of the polishing pad into alignment with the support surface of the platen and move a second portion of the polishing pad spaced apart from the first portion out of alignment with the support surface of the platen; and a support pad positioned partially between the polishing pad and the platen, the support pad being movable with the polishing pad and having a first portion in contact with the first portion of the polishing pad when the first portion of the polishing pad is aligned with the platen, the support pad further having a second portion out of contact with the polishing pad when the second portion of the polishing pad is out of alignment with the platen, the apparatus further comprising a milling device positioned proximate to the support pad and having at least one sharpened engaging surface positioned to remove a selected amount of material from the support pad.

72. The apparatus of claim 71 wherein the polishing pad extends between a supply roller and a take-up roller.

73. The apparatus of claim 71, further comprising a first roller positioned proximate to the platen and a second roller spaced apart from the first roller, wherein the support pad forms a continuous loop extending around the first and second rollers.

74. An apparatus for planarizing a microelectronic substrate, comprising:

a platen having a support surface;

an elongated polishing pad moveable relative to at least a portion of the platen to move a first portion of the polishing pad into alignment with the support surface of the platen and move a second portion of the polishing pad spaced apart from the first portion out of alignment with the support surface of the platen; and a support pad positioned partially between the polishing pad and the platen, the support pad being movable with the polishing pad and having a first portion in contact with the first portion of the polishing pad when the first portion of the polishing pad is aligned with the platen, the support pad further having a second portion out of contact with the polishing pad when the second portion of the polishing pad is out of alignment with the platen, wherein the polishing pad is coupled to an actuator to move at a selected rate relative to the portion of the platen, further wherein the support pad is engaged with the polishing pad to move with the polishing pad at the selected rate.

75. The apparatus of claim 74 wherein the polishing pad extends between a supply roller and a take-up roller.

76. The apparatus of claim 74, further comprising a first roller positioned proximate to the platen and a second roller spaced apart from the first roller, wherein the support pad forms a continuous loop extending around the first and second rollers.

77. The apparatus of claim 74, further comprising a pad supply roller and a pad take-up roller spaced apart from the pad supply roller, wherein the support pad is elongated between a first end coupled to the pad supply roller and a second end coupled to the pad take-up roller.

78. An apparatus for planarizing a microelectronic substrate, comprising:

a platen having a support surface;

an elongated polishing pad moveable relative to at least a portion of the platen to move a first portion of the polishing pad into alignment with the support surface of the platen and move a second portion of the polishing pad spaced apart from the first portion out of alignment with the support surface of the platen; and a support pad positioned partially between the polishing pad and the platen, the support pad being movable with the polishing pad and having a first portion in contact with the first portion of the polishing pad when the first portion of the polishing pad is aligned with the platen, the support pad further having a second portion out of contact with the polishing pad when the second portion of the polishing pad is out of alignment with the platen, wherein the support surface of the platen has a plurality of orifices coupleable to a source of pressurized fluid for introducing the fluid between the support surface and the support pad to at least partially separate the support pad from the support surface.

79. The apparatus of claim 78 wherein the polishing pad extends between a supply roller and a take-up roller.

80. The apparatus of claim 78, further comprising a first roller positioned proximate to the platen and a second roller spaced apart from the first roller, wherein the support pad forms a continuous loop extending around the first and second rollers.

81. The apparatus of claim 78, further comprising a pad supply roller and a pad take-up roller spaced apart from the pad supply roller, wherein the support pad is elongated between a first end coupled to the pad supply roller and a second end coupled to the pad take-up roller.

82. An apparatus for supporting a polishing pad during planarization of a microelectronic substrate, comprising:

a platen having a support surface with a plurality of orifices, the orifices being in fluid communication with a source of pressurized fluid for directing the fluid through the orifices and away from the platen; and an elongated support pad adjacent to the support surface of the platen, the support pad having a first surface facing away from the platen for engaging the polishing pad and a second surface facing toward the platen, at least a portion of the second surface of the support pad being separated from the support surface of the platen when the pressurized fluid passes through the orifices away from the platen, wherein the orifices are in fluid communication with a source of pressurized gas.

83. The apparatus of claim 82 wherein the support pad is moveable relative to the platen between a first position with a portion of the support pad in contact with a portion of the polishing pad and a second position with the portion of the support pad out of contact with the polishing pad.

84. The apparatus of claim 82, further comprising a pad supply roller and a pad take-up roller, wherein the support pad is elongated between a first end coupled to the pad supply roller and a second end coupled to the pad take-up roller.

85. The apparatus of claim 82, further comprising a first roller positioned proximate to the platen and a second roller spaced apart from the first roller, wherein the support pad forms a continuous loop extending around the first and second rollers.

86. The apparatus of claim 82 wherein the orifices are in fluid communication with a source of pressurized liquid.

* * * * *